US007779899B2

(12) United States Patent
Jibb et al.

(10) Patent No.: US 7,779,899 B2
(45) Date of Patent: Aug. 24, 2010

(54) PLATE-FIN HEAT EXCHANGER HAVING APPLICATION TO AIR SEPARATION

(75) Inventors: Richard John Jibb, Amherst, NY (US); Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 885 days.

(21) Appl. No.: 11/454,802

(22) Filed: Jun. 19, 2006

(65) Prior Publication Data

US 2007/0289726 A1 Dec. 20, 2007

(51) Int. Cl.
*F28F 3/00* (2006.01)
*F28D 7/10* (2006.01)
*F25B 41/00* (2006.01)

(52) U.S. Cl. ..... 165/166; 165/140

(58) Field of Classification Search ..... 165/165, 165/166, 140, 144–145; 62/512, 513, 903, 62/643

See application file for complete search history.

(56) References Cited

U.S. PATENT DOCUMENTS 3,256,704 A * 6/1966 Becker ..... 165/166
3,372,453 A 3/1968 Butt ..... 29/157.3
3,559,722 A * 2/1971 Schauls et al. ..... 165/166
3,983,191 A * 9/1976 Schauls ..... 261/114.1
4,297,775 A 11/1981 Butt et al. ..... 29/157.3
4,330,308 A * 5/1982 Grenier et al. ..... 165/166
4,496,382 A * 1/1985 Geist et al. ..... 62/623
5,144,809 A * 9/1992 Chevalier et al. ..... 165/166
6,044,902 A * 4/2000 Pahade et al. ..... 165/166
7,188,492 B2 3/2007 Corduan et al.
2002/0011331 A1 1/2002 Lehman et al. ..... 165/166
2004/0244416 A1 12/2004 Garnier et al. ..... 62/643

FOREIGN PATENT DOCUMENTS

EP 398593 3/2004
FR 2799277 4/2001
FR 2844040 8/2002
FR 2881515 8/2006

* cited by examiner

*Primary Examiner*—Tho v Duong
(74) *Attorney, Agent, or Firm*—David M. Rosenblum

(57) ABSTRACT

A plate-fin heat exchanger having alternating layers for exchanging heat between fluids to be warmed against fluids to be cooled. One or both of the layers is subdivided into flow passages to allow for the flow of two or more fluids flowing through one of the layers to engage in indirect heat transfer with one or more fluids flowing through another adjacent layer. The flow through the heat exchanger is parallel to the width of the heat exchanger. The first and second layers provide a greater cross-sectional flow area for each of the fluids than otherwise would have been provided had the fluids flow been parallel to the length of the heat exchanger with layers thereof dedicated to the flow of each of the fluids.

6 Claims, 3 Drawing Sheets

PLATE-FIN HEAT EXCHANGER HAVING APPLICATION TO AIR SEPARATION

FIELD OF THE INVENTION

The present invention relates to a plate-fin heat exchanger having application to air separation in which the warm and cold fluids to be brought into an indirect heat exchange relationship are located in alternating layers having opposed inlets and outlets along the length dimension of the heat exchanger. More particularly, the present invention relates to such a plate-fin heat exchanger in which each of the layers can be partitioned transversely into flow passages for flow of multiple fluids to be brought into an indirect heat exchange with fluids flowing in an adjacent layer.

BACKGROUND OF THE INVENTION

Plate-fin heat exchangers have particular application in cryogenic plants that are used in natural gas processing and in air separation. Such heat exchangers are typically fabricated from brazed aluminum heat exchanger cores that are fully brazed and welded in a vacuum brazing oven. In a typical brazing operation, fins, parting sheets and end bars are stacked to form a core matrix. The core matrix is placed in the vacuum brazing oven where it is heated to the brazing temperature in a clean vacuum environment.

Small air separation plants, typically less than 400 tons per day oxygen, utilize a heat exchanger that can comprise a single core. However, for higher flows and heat exchange duty, the plate-fin heat exchanger is constructed from several of such cores that are connected in parallel or series.

Heat exchanger efficiency is limited by the fact that each heat exchanger must be formed from individually brazed cores, which are in turn constrained in maximum cross-sectional flow area because the brazing ovens are limited in size. Typically, such brazing ovens have a length of between about 8.5 meters and about 10.0 meters and a width of between about 1.3 and 2.0 meters. Consequently, the length, width and height of any plate-fin heat exchanger is limited by the size of the furnace.

Typically, inlets and outlets for the fluids to be subjected to heat exchange are positioned at opposite ends of the longest dimension, namely, the length. If the heat exchanger were to be fabricated that is more compact, fin density would have to increase in order to provide an effective heat exchange area. Fin density is defined as the number of individual fins extending from the top to the bottom of a flow passage per inch of flow width. Obviously using higher fin density will result in a higher heat transfer surface area per unit volume. The increase in surface area inevitably comes at the expense of more frictional pressure drop. Hence, increasing fin density would increase the pressure drop. In applications such as air separation, air is compressed and purified and thereafter, the air is cooled to near its dew point prior to introduction into a distillation column. The product and waste streams produced by the distillation column flow back through the heat exchanger to cool the incoming air. Obviously, if the fin density were increased and therefore the pressure drop, the air would have to be compressed to a much higher pressure to overcome the increase in pressure drop for both the incoming air stream and the product and waste streams. While the degree of increase in compression that is required to overcome such increased pressure drop for the incoming air stream is not particularly severe, the amount of increased compression required for the product and waste streams is at an undesirable high level.

In order to lessen the pressure drop for a particular heat exchanger, it is known to utilize inlets and outlets for the flow along the length dimension (i.e. the longest dimension of the plates from which the heat exchanger is formed) of the heat exchanger in order to take advantage of a higher cross-sectional flow area inherent in such design. For example, in French Patent Application 2844040, the incoming air, nitrogen and oxygen is subjected to indirect heat exchange in alternating layers in which inlets and outlets for these components are situated along the length dimension. However, at each inlet of a plate-fin heat exchanger, distribution fins must be provided to redistribute the flow across the length dimension of the heat exchanger. The problem with such redistribution points is that they each cause the flow to change direction and therefore incur a pressure drop for such reason alone. Furthermore, where two or more streams are to be exchanged with the incoming air, separate layers for the streams to be warmed must be alternated with layers for the air stream to be cooled. Typically, two streams to be warmed are alternated with a stream to be cooled. The order of the layers in such a heat exchanger adds complexity to the design and the costs of fabrication.

Furthermore, since the flow of each layer must be distributed many times along the length, it is difficult to connect such heat exchangers in series should scale-up become necessary. This is due to the fact that the flow must be redistributed in a downstream heat exchanger and such redistribution can lead to an unacceptable pressure drop.

As will become apparent, the present invention provides a plate-fin heat exchanger in which the layering is configured such that layers for a stream to be cooled alternate with a single layer designed to accommodate the streams to be warmed. Furthermore, as will become apparent, a heat exchanger design in accordance with the present invention is far easier to scale up with a series connection between heat exchangers than in prior art designs. These and other advantages of the present invention will be discussed in detail below.

SUMMARY OF THE INVENTION

The present invention provides a plate-fin heat exchanger in which a plurality of layers are formed by a first layer alternating with a second layer. The first and second layer allow for indirect heat exchange between at least a first fluid flowing through the first layer and at least second and third fluids flowing through the second layer. Each of the first and second layer has fins. The plurality of layers are arranged in a stack, one on the other, to define a length and a width by an outer periphery of the plurality of layers, the length being longer than the width.

The second of the layers is subdivided into at least two transverse sections. Each of the at least two transverse sections are partitioned into at least two flow passages for flow of the at least second and third fluids, respectively. Opposed inlets and outlets are positioned along the length of the first layer and the second layer such that the at least the first fluid flows through the first layer and the at least the second and third fluids flow through the at least two flow passages of each of the two sections of the second layer in flow directions parallel to one another and in a direction traversing the width of the plate-fin heat exchanger.

As indicated above, this design allows the "layering" of the heat exchanger to be carried out in a simplified fashion due to the fact that there are only two layer designs, namely, one design for the first fluid alternating with another design for the other of the second and third and etc. fluids to be brought into indirect heat exchange with the first fluid or fluids. In this regard, the first layer could be partitioned for the flow of multiple fluids in a similar fashion to the second layer.

Since the second layers or possibly also the first layers are partitioned for multiple flows, there is no need to distribute the flow across the entire length dimension to prevent an excessive pressure drop from being produced by such redistribution. In this regard, the plate-fin heat exchanger of the present invention can incorporate a "series design" in which the first layer and the second layer are each divided into lengthwise sections in flow communication with one another. Each of these sections can have the width of a brazing furnace and as such heat exchangers incorporating such design can be easily scaled to accommodate a greater heat exchange duty by providing more lengthwise sections. Since the flow is fully distributed in each section, the need to redistribute flows between each section is minimized and therefore the pressure drop produced on account of such redistribution. Furthermore, since the inlets and outlets are positioned along the length dimension and flow passages are repeated within transverse sections, the total cross-sectional area for flow of each of the first fluid and each of the at least second and third fluids can be made greater than would otherwise have been obtained had the inlets and outlets been positioned at end locations of each of the lengthwise sections. This allows for less of a pressure drop within each section and the use of higher density fins with the advantage of either increasing the effective heat exchange area of each of the lengthwise section or making such lengthwise sections more compact.

In any embodiment of the present invention, the inlets and the outlets can be positioned such that flow of the first fluid is in a counter-current direction to that of the at least second and third fluids. In a particular application of the present invention, the at least the first fluid is air to be cooled for an air separation plant and the at least second and third fluids are a nitrogen-rich vapor stream, a refrigeration stream and a waste stream produced by the air separation plant. In such application, the lengthwise sections of the first layer are first and second separate lengthwise sections connected to one another by a conduit so that the at least the first fluid flows from the first to the second separate lengthwise section. Further, the lengthwise sections of the second layer are first and second connected lengthwise sections that are positioned in direct flow communication with one another so that the at least second and third fluids flow from the first to the second connected lengthwise sections.

Each of the at least two transverse sections of the first of the connected lengthwise sections is divided into first, second and third flow passages for the flow of the nitrogen-rich vapor stream, the refrigeration stream and the waste stream, respectively. Each of the at least two transverse sections of the second of the connected lengthwise sections is divided into fourth and fifth flow passages in flow communication with the first and the second of the flow passages and with a gap extending between the first and second of the connected lengthwise sections. The third of the flow passages terminates between the first and second connected lengthwise sections and is provided with a subsidiary outlet within the gap to discharge the fourth of the fluids from the plate-fin heat exchanger.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
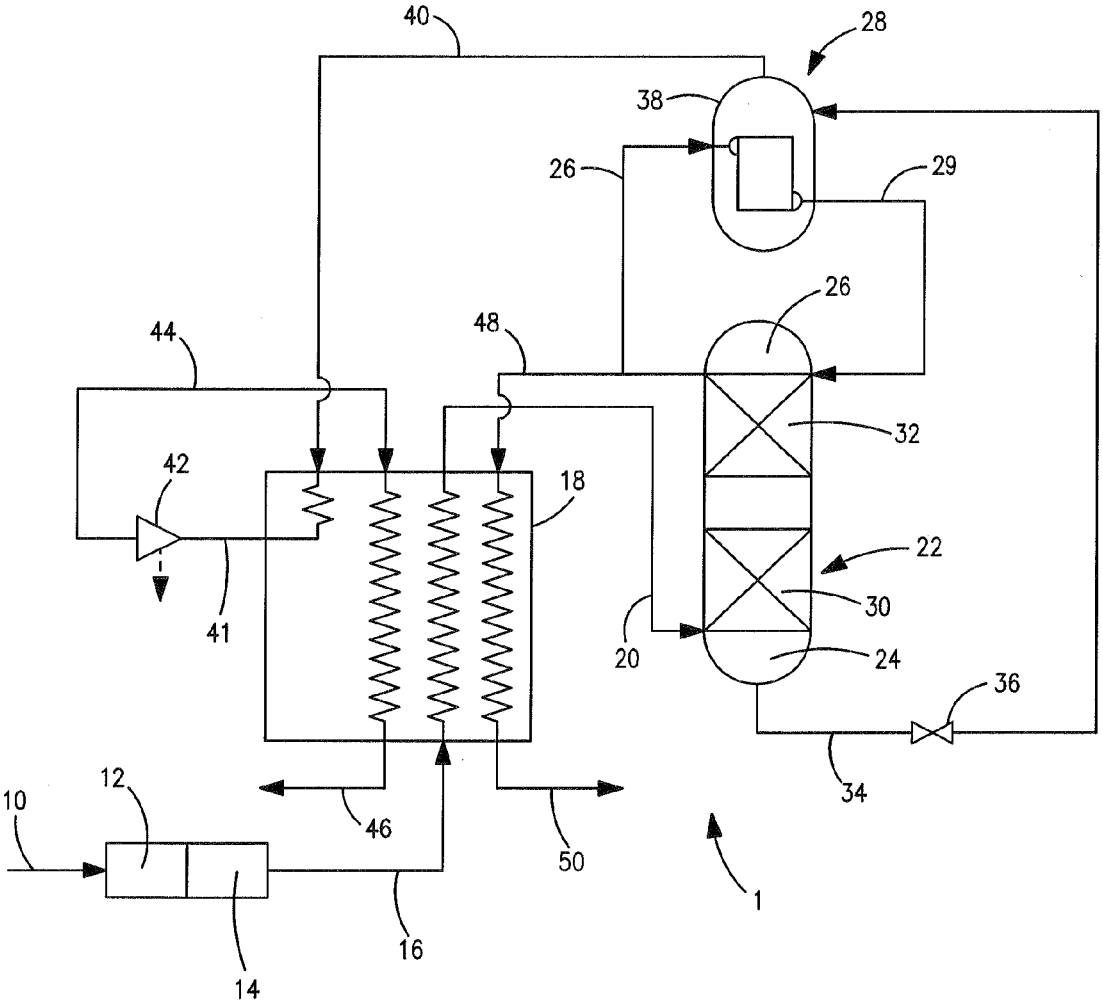
FIG. 1 is a schematic diagram of an air separation plant in accordance with the present invention.

With reference to FIG. 1 an air separation plant 1 is illustrated that is used to generate nitrogen. Such an air separation plant is known as a nitrogen generator.

A feed air stream 10 is compressed at a compression unit 12 that may be a multistage compressor having inter-stage cooling between stages. The compressed and purified air stream is then introduced into a purification unit 14 that is well known in the art. Prepurification unit 14 that can be a temperature swing adsorption unit having beds of alumina or molecular sieve type adsorbent operating out of phase to remove the lower boiling components of the air such as water and carbon dioxide. The resultant compressed and purified stream 16 is cooled to at or near its dew point in main heat exchanger 18 and introduced as a compressed, purified and cooled stream 20 into a distillation column 22.

The introduction of compressed, purified and cooled air stream 20 into distillation column 22 initiates the formation of an ascending vapor phase that becomes evermore rich in nitrogen as it ascends distillation column 22 to produce an oxygen-rich liquid column bottoms 24 and a nitrogen-rich column overhead 26. A first nitrogen-rich vapor stream 26 is condensed within a condenser 28 to return a liquid reflux stream 28 to distillation column 22. The return of liquid reflux stream 29 initiates the formation of a descending liquid phase 29 that becomes evermore rich in oxygen as it descends column 22.

The ascending vapor phase and the descending liquid phase are contacted by mass transfer contact elements 30 and 32 that can be a known structured packing, a random packing or known sieve trays.

An oxygen-rich column bottoms stream 34 is expanded to a lower temperature within an expansion valve 36 and then introduced into a shell 38 of condenser 28 for partial vaporization thereof against the liquefaction of the first nitrogen-rich vapor stream 26. The partially vaporized oxygen-rich liquid column bottoms produces a waste stream 40 that is partially warmed within main heat exchanger 18 and then introduced as a partly warmed waste stream 41 into a turboexpander 42 to produce a refrigerant stream 44 that is fully warmed within main heat exchanger 18 and discharged as a waste stream 46. This action adds refrigeration to air separation plant 1 to maintain it at cryogenic temperatures. Part of the work of expansion can be employed in powering compression unit 12. A second nitrogen-rich vapor stream 48 is fully warmed within main heat exchanger 18 to produce a product nitrogen stream 50.

Thus, the incoming compressed and purified air stream 16 is fully cooled through indirect heat exchange with waste stream 40, the refrigeration stream 44 and the second nitrogen-rich vapor stream 48.

Figure 2:
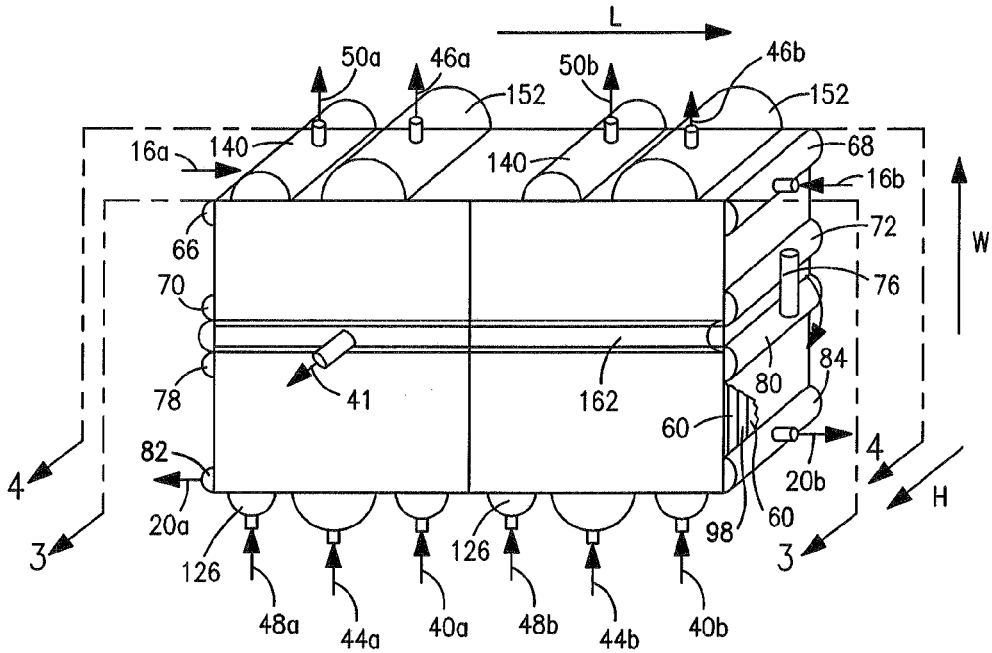
FIG. 2 is a perspective view of a plate-fin heat exchanger in accordance with the present invention.
Figure 3:
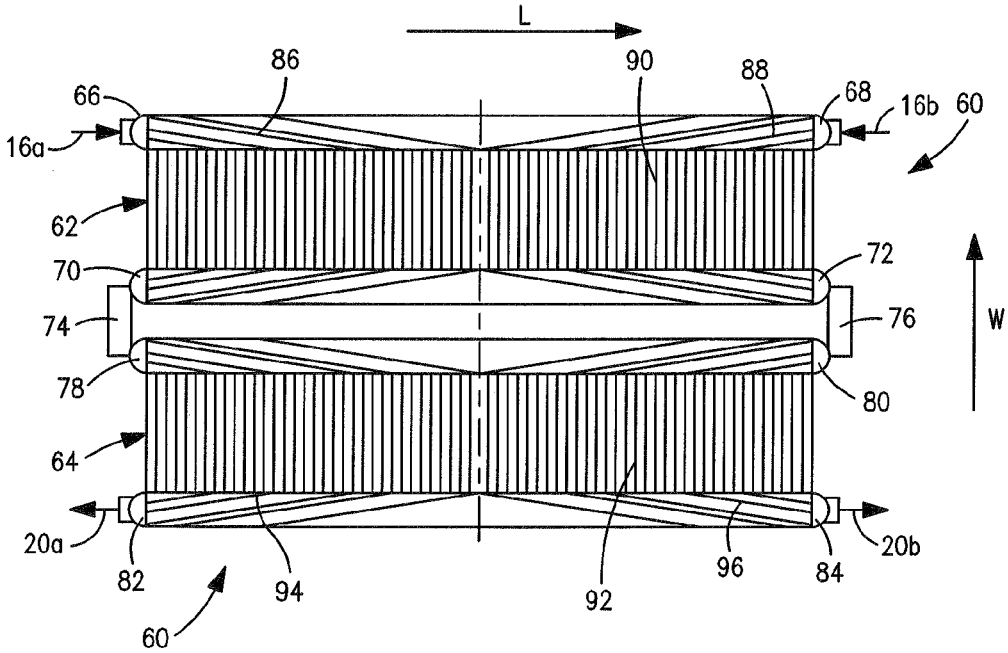
FIG. 3 is a sectional, schematic view taken along line 3-3 of FIG. 2 illustrating a layer of the plate-fin heat exchanger shown in FIG. 2.
Figure 4:
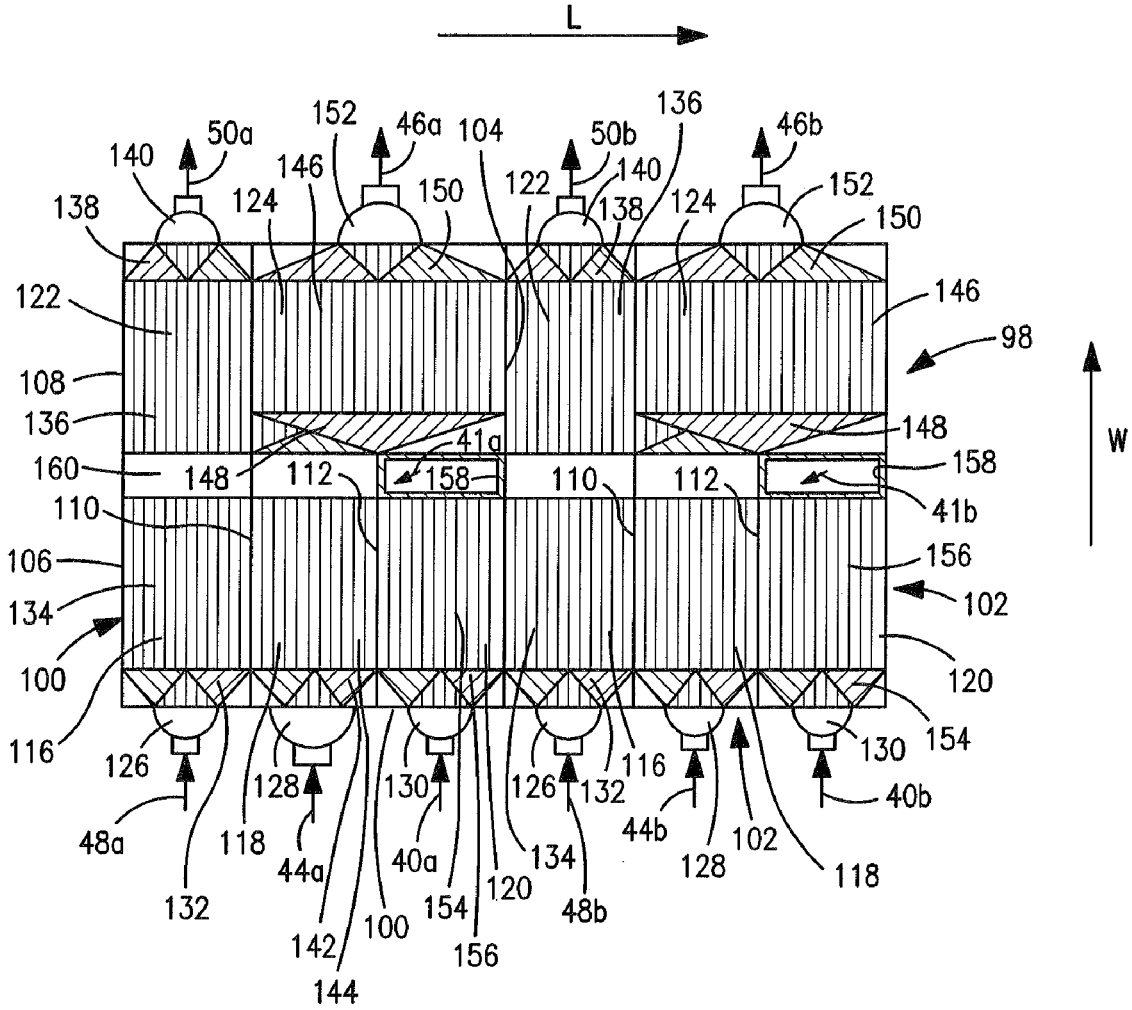
FIG. 4 is a sectional, schematic view of the plate-fin heat exchanger illustrated in FIG. 2 taken along line 4-4 of FIG. 2 showing the layer adjacent to the layer shown in FIG. 3.

With reference to FIG. 2, plate-fin heat exchanger 18 is illustrated. Plate-fin heat exchanger 18 has alternating layers stacked one on the other that are illustrated in FIGS. 3 and 4. Typically, there are 80 to 150 or more of such layers. Each of the layers is formed between two parting sheets and is sealed about its outer periphery by side and end bars. The side and end bars are not illustrated for purposes of simplicity of explanation. Plate-fin heat exchanger 18 has a length "L" a width "W" and a height "H". The layers are stacked to form the height "H" of heat exchanger 18 and the outer periphery formed of the end bars defines the length "L" and the width "W". As illustrated, the length "L" is longer than the width "W".

With additional reference to FIG. 3, a first layer 60 is provided for cooling incoming compressed and purified air stream 16. First layer 16 is formed by two separate lengthwise sections 62 and 64. Separate lengthwise section 62 is provided with opposed inlet headers 66 and 68 for introduction of the compressed and purified air stream 16. In this regard, the compressed and purified air stream 16, although not illustrated, is subdivided into streams 16*a* and 16*b*. After partial cooling of the compressed and purified air stream 16 within separate lengthwise section 62, the stream flows out of intermediate outlet headers 70 and 72, through intermediate outlet conduits 74 and 76, intermediate inlet headers 78 and 80 and then into separate lengthwise section 64. After passage of compressed and purified air stream 16 through separate lengthwise section 64, the resultant compressed, purified and cooled air stream 20 is discharged from outlet headers 82 and 84 as compressed and purified air streams 20*a* and 20*b* that again are connected to a manifold to form compressed, purified and cooled air stream 20.

The inlets for the compressed and purified air stream to the lengthwise extending section 62 are provided by inlet headers 66 and 68 and redistribution fins 86 and 88. The redistribution fins 86 and 88 cause the flow to change direction so that the flow is parallel with the width "W" and hence, such inlets can be seen to be principally along the length "L". The redistribution fins 86 and 88 also distribute the flow across the length "L". After the flow is redistributed, the flow passes parallel to fins 90 and 92. Upon discharge, the flow passes through redistribution fins 94 and 96, causing the fluid to change direction again and pass to outlet headers 82 and 84. As a result, the cross-sectional flow area is partly defined by the length "L" as opposed to the width "W" as would be the case in a conventional plate-fin heat exchanger in which the flow is parallel to the length "L". Hence, the outlet for layer 60 is again principally along the length "L" and is provided by redistribution fins 94 and 96 and outlet headers 82 and 84. As can be appreciated such changes in flow produce a pressure drop and therefore, for a particularly long plate-fin heat exchanger intermediate inlets and outlets and redistribution fins could be provided between inlet headers 66 and 68 and outlet headers 82 and 84. Furthermore, although not illustrated, gaps within the end bars associated with layer 60 and the separate lengthwise sections 62 and 64 thereof would be provided, as would be well known in the art, in registry with the inlet headers 66, 68 and the outlet headers 82, 84 to allow flow to enter separate lengthwise section 62 and to be discharged from separate lengthwise section 64.

With principal reference again to FIG. 2, preferably, flowing counter-current to the air to be cooled within plate-fin heat exchanger 18 are the process streams produced in distillation column 22 and a condenser 28 and the turboexpander 42, namely, second nitrogen-rich vapor stream 48, refrigerant stream 44 and waste stream 40. Nitrogen-rich vapor stream 48 is subdivided into streams 48*a* and 48*b*, refrigerant stream 44 is subdivided into streams 44*a* and 44*b* and waste stream 40 is subdivided into streams 40*a* and 40*b*. The subdividing of the streams takes places as a result of simple manifolds, not shown. After such subdivision, the streams are fed into plate-fin heat exchanger 18 to produce product streams 50*a* and 50*b*, waste streams 46*a* and 46*b* and partly warmed waste stream 41. Again, two manifolds, not shown, are provided for combining product streams 50*a* and 50*b* into product stream 50 and waste streams 46*a* and 46*b* into waste stream 46.

With additional reference to FIG. 4, a second layer 98 is provided for flow of second nitrogen-rich streams 48*a* and 48*b*, refrigerant streams 44*a* and 44*b* and waste streams 40*a* and 40*b*. Second layer 98 is divided into two transverse sections 100 and 102 by a partition bar 104. Further, second layer 98 is also divided into connected lengthwise sections 106 and 108. The two transverse sections 100 and 102 of connected lengthwise section 106 are each partitioned by partition bars 110, 112 and partition bar 104 into flow passages 116, 118 and 120. The two transverse sections 100 and 102 of connected lengthwise section 108 are each divided by partition bar 110 and partition bar 104 into flow passages 122 and 124.

The inlets and outlets for second layer 98 are provided along the length "L" dimension as inlet headers 126, 128 and 130 for second nitrogen-rich streams 48*a* and 48*b*, refrigerant streams 44*a* and 44*b* and waste streams 40*a* and 40*b*, respectively.

Second nitrogen-rich streams 48*a* and 48*b* flow through distribution fins 132, from flow passage 116 to flow passage 122 and along sets of fins 134 and 136. Thereafter, second nitrogen-rich streams 48*a* and 48*b* after having been fully warmed pass through distribution fins 138 and are discharged through outlet header 140 as product streams 50*a* and 50*b*.

Refrigerant streams 44*a* and 44*b* flow into inlet headers 128, distribution fins 142, from flow passage 118 to flow passage 124. Flow passage 118 and flow passage 124 is provided with fins 144 and 146. Since flow passage 124 is wider than flow passage 118, it is provided with intermediate distribution fins 148. The waste streams 46*a* and 46*b* are then discharged through distribution fins 150 to outlet headers 152.

The waste streams 40*a* and 40*b* pass through distribution fins 154, parallel to fins 156 and then are discharged as partly warmed waste streams 41*a* and 41*b* to outlets 158 that are positioned between connected lengthwise section 106 and 108 in a gap 160 provided to accommodate outlets 158. The partly warmed waste streams 41*a* and 41*b* flow out of outlet header 162 that can be seen in FIG. 2, in flow communication with outlets 158 as partly warmed waste stream 41.

Again, although not illustrated, the side bars of second layer 98 would be provided with gaps in registry with the inlet headers 126, 128, 130 and the outlet headers 140, 152 to allow related flows to enter and leave the flow passages formed within second layer 98.

With additional reference again to FIG. 3, it can be seen that heat exchanger 18 is in reality two heat exchangers in series. One of the heat exchangers is provided by the second separate lengthwise section 64 of first layer 60 and first connected lengthwise section 106 of second layer 98. The other heat exchanger is provided by first separate lengthwise section 62 of first layer 60 and second connected lengthwise section 108 of second layer 98. This is done so as to provide sufficient heat exchange duty for the streams to be cooled and warmed. As can be appreciated, intermediate lengthwise sections could be used for further expansion. Each lengthwise section is no wider than a brazing furnace. Furthermore, the flows in passages between the lengthwise sections are accomplished with a minimum amount of redistribution that could increase the pressure drop. While redistribution fins 148 are provided for flow passage 124, since the flow passage widens and there is a decrease in flow velocity there will also be a reduction in pressure drop. Lastly, if plate-fin heat exchanger is viewed as two heat exchangers connected in series, it is also readily apparent that the cross-sectional flow area for each of the streams to be warmed, namely second nitrogen-rich stream 48, refrigerant stream 44 and waste stream 40 is greater than had the streams flowed through each of the heat exchangers in the lengthwise direction given by length "L" due to the fact that second layer 98 is divided into portions 100 and 102. This allows the use of more dense fins such as fins 134, 148; 144, 146; and 156 to increase the effective area for heat transfer to compensate for the decrease in flow length given the fact that all flows are parallel with width "W". The actual fin density selected will of course depend on the amount of heat transfer duty required for plate-fin heat exchanger 18 and the size of air separation plant 1.

Although a plate-fin heat exchanger has been described with reference to one used in connection with a nitrogen generator, the invention should not be taken as having such limited applicability. In this regard, the invention could be applied to a heat exchanger having a first layer for flow of a fluid to exchange heat with two or more other fluids flowing in an alternating layer. The heat exchange may be to warm the fluid flowing in the first layer. Furthermore, in case expansion of flow length is not desired, a heat exchanger in accordance with the present invention could be constructed from only two adjacent sections of two layers. Although second layer 98 is illustrated as being divided into two portions 100 and 102, more portions could be utilized.

While the invention has been described with respect to a preferred embodiment, as will occur to those skilled in the art, numerous changes, additions and omissions may be made without departing from the spirit and scope of the present invention provided for in the appended claims.

We claim:

1. A plate-fin heat exchanger comprising:

a plurality of layers formed by a first layer alternating with a second layer for indirectly exchanging heat between at least a first fluid flowing through the first layer and at least second and third fluids flowing through the second layer;

the plurality of layers being arranged in a stack, one on the other, to define a length and a width for the plate-fin heat exchanger by an outer periphery of the plurality of layers, the length being longer than the width;

the first layer and the second layer configured such that the at least the first fluid flowing through the first layer and the at least second and third fluids flowing through the second layer all flow in a direction parallel to the width of the plate-fin heat exchanger during indirect heat exchange between the at least the first fluid and the at least the second and third fluids and each of the first layer and the second layer having fins;

the second of the adjacent layers subdivided into at least two transverse sections, each of the at least two transverse sections partitioned into at least two flow passages for flow of streams of the at least second and third fluids, respectively; and opposed inlets and outlets positioned along the length of the first layer and the second layer such that the at least the first fluid flows through the first layer and the at least the second and third fluids flow through the at least two flow passages of each of the two sections of the second layer parallel to one another and in the direction parallel to the width of the plate-fin heat exchanger.

2. The plate-fin heat exchanger of claim 1, wherein the first layer and the second layer are each divided into lengthwise sections in flow communication with one another.

3. The plate-fin heat exchanger of claim 2, wherein the total cross-sectional area for flow of each of the at least the first fluid and the at least second and third fluids is greater than would otherwise have been obtained had the inlets and outlets been positioned at end locations of each of the lengthwise sections.

4. The plate-fin heat exchanger of claim 1, wherein flow of the at least the first fluid is in a counter-current direction to that of the at least second and third fluids.

5. The plate-fin heat exchanger of claim 3, wherein flow of the at least the first fluid is in a counter-current direction to that of the at least the second and third fluids.

6. The plate-fin heat exchanger of claim 5, wherein:

the at least the first fluid is air to be cooled for an air separation plant and the at least second and third fluids are a nitrogen-rich vapor stream, a refrigeration stream and a waste stream produced by the air separation plant;

the lengthwise sections of the first layer are first and second separate lengthwise sections connected to one another by a conduit so that fluid flows from the first to the second separate lengthwise section;

the lengthwise sections of the second layer are first and second connected lengthwise sections positioned in direct flow communication with one another so that the at least second and third fluids flow from the first to the second connected lengthwise sections;

each of the at least two transverse sections of the first of the connected lengthwise sections is divided into first, second and third of the flow passages for the flow of the nitrogen-rich vapor stream, the refrigeration stream and the waste stream, respectively;

each of the at least two transverse sections of the second of the connected lengthwise sections is divided into fourth and fifth flow passages in flow communication with the first and the second of the flow passages and with a gap extending between the first and second of the connected lengthwise sections; and the third of the flow passages terminates between the first and second connected lengthwise sections and is provided with a subsidiary outlet within the gap to discharge the fourth of the fluids from the plate-fin heat exchanger.

* * * * *